US005102310A

United States Patent [19]

Gander et al.

[11] Patent Number: 5,102,310

[45] Date of Patent: Apr. 7, 1992

[54] AXIAL PISTON PUMP

[75] Inventors: Martin Gander, Tamins; Hans J. Jösler, Bonaduz; Elmar Morscher, Domat/Ems; Thomas Neher, Chur; Jean-Marie Zogg, Bonaduz, all of Switzerland

[73] Assignee: Drägerwerk Aktiengesellschaft, Lübeck, Fed. Rep. of Germany

[21] Appl. No.: 591,794

[22] Filed: Oct. 2, 1990

[30] Foreign Application Priority Data

Oct. 6, 1989 [CH] Switzerland ..... 3666/89

[51] Int. Cl.[5] ..... F04B 7/06

[52] U.S. Cl. ..... 417/500; 417/492; 417/63; 464/161

[58] Field of Search ..... 417/492, 500, DIG. 1, 417/63; 464/160, 161, 24, 26

[56] References Cited

U.S. PATENT DOCUMENTS

| | | | |
|---|---|---|---|
| 1,819,994 | 8/1931 | Claytor | 417/60 |
| 1,836,871 | 12/1931 | Ricker | 417/56 |
| 1,846,000 | 2/1952 | Fletcher | 417/53 |
| 1,919,547 | 4/1933 | Fletcher | 417/56 |
| 1,947,511 | 2/1934 | Baggett | 417/58 |
| 2,001,012 | 5/1935 | Burgher | 417/56 |
| 2,237,408 | 4/1941 | Burgher | 417/56 |
| 2,267,902 | 12/1941 | Eddins | 417/60 |
| 2,714,855 | 8/1955 | Brown | 417/57 |
| 2,865,455 | 12/1958 | Rhoads | 417/56 |
| 2,937,598 | 5/1960 | Brown | 417/58 |
| 3,095,819 | 7/1963 | Brown et al. | 417/56 |
| 3,230,892 | 1/1966 | Burns | 417/492 |
| 3,410,217 | 4/1967 | Kelley et al. | 417/56 |
| 3,424,066 | 1/1969 | Moore | 417/56 |
| 4,070,134 | 1/1987 | Gramling | 417/56 |
| 4,465,435 | 8/1984 | Copas | 417/56 |
| 4,678,411 | 7/1987 | Wieland | 417/500 |
| 4,696,624 | 9/1987 | Bass et al. | 417/56 |
| 4,712,981 | 12/1987 | Gramling | 417/56 |
| 4,869,646 | 9/1989 | Gordon et al. | 417/63 |

FOREIGN PATENT DOCUMENTS

| | | | |
|---|---|---|---|
| 525963 | 6/1956 | Canada . | |
| 03644 | 6/1987 | World Int. Prop. O. | 417/500 |

OTHER PUBLICATIONS

"Casing Pumps", Oil and Gas Journal, Apr. 13, 1987, pp. 42–47.

*Primary Examiner*—Richard A. Bertsch
*Assistant Examiner*—Charles G. Freay
*Attorney, Agent, or Firm*—McGlew & Tuttle

[57] ABSTRACT

The periodic axial movement of the rotary piston (6) is performed by a cam mechanism which has a cam surface (8) rotating around the piston axis and a cam follower (9) that is in functional connection with the cam holder. The relative position of the cam holder determines the piston stroke in the course of one revolution. In this arrangement, the drive shaft (5) can extend coaxially with the piston (6). In a particularly advantageous manner, the follower is pressed against the cam holder under spring pre-tension.

9 Claims, 4 Drawing Sheets

AXIAL PISTON PUMP

FIELD OF THE INVENTION

The present invention pertains generally to an axial piston pump and more particularly to an axial piston pump including a cylinder with two cylinder openings and a piston coupled to a drive shaft for rotation around a central axis, the piston being displaceable in an axial direction for performing a lifting movement, the piston having a recess which communicates with openings of the cylinder.

BACKGROUND OF THE INVENTION

Such valveless pumps with a single rotary piston are used, for example, as metering pumps for fluids in all those cases in which accurately metered amounts must be delivered. Depending on the direction of rotation of the rotary piston, the direction [of delivery] of the pump is reversible. The piston closes itself on the delivery or suction side, so that no shutoff or check valves are needed. The delivery capacity of the pump can be controlled in a particularly simple manner by varying the rotation speed.

In prior-art pumps, the periodic axial movement of the piston is generated by a type of crank mechanism. The crank is fastened to the rotary piston, and the end of the crank is hinged to a cam plate on the drive shaft. Such a mechanism is described, e.g., in U.S. Pat. No. US-A-3,168,872. The cylinder with the rotary piston movable therein is mounted such that the piston axis can be deflected relative to the axis of the drive shaft. As long a the drive shaft and the piston are arranged such that they are coaxial, the piston only rotates in the cylinder and does not perform a stroke. As soon as the piston axis is deflected, the piston is displaced in the cylinder as a consequence of the different planes of rotation of the cam plate and the crank. The desired piston stroke can be set by selecting the degree of deflection of the piston axis relative to the axis of the drive shaft.

One disadvantage of the prior-art pump drive is the fact that the displacing clutches are subject to relatively great mechanical stress and are therefore liable to malfunction. In addition, it is not always possible or desirable for the drive shaft to be put in an oblique position relative to the piston axis.

SUMMARY OF THE INVENTION

Therefore, a task of the present invention is to provide an axial piston pump of the type mentioned in the introduction, in which the stroke movement of the piston can be performed in a simple manner and with the smallest wear possible. In addition, whenever possible, the drive shaft shall be coaxial with the rotary piston.

According to the invention, an axial piston pump is provided comprising a cylinder with at least two cylinder openings and a piston positioned within the cylinder, the piston being coupled to a drive shaft for rotation about a central piston axis. The piston is displaceable in an axial direction for performing a lifting movement. The piston includes at least one end with a recess in the area of the cylinder openings. The recess communicates with one of the cylinder openings during the performance of the pistons stroke. The axial movement is provided by axial movement means including a cam mechanism with a cam holder or cam surface rotating around the piston axis and a follower which is positioned engaging the cam holder such that the relative position of the cam holder determines the pistons stroke during each revolution.

The cam mechanism according to the invention is substantially more robust and more wear-resistant than the prior-art crank clutches. Depending on the arrangement and the design of the cam holder and the follower, it is possible to select totally different solutions, in which, however, the drive shaft can always be arranged such that it is coaxial with the piston. However, it would also be definitely possible for the drive shaft to extend obliquely, in which case the transmission of force takes place, e.g., via a conventional universal joint.

A particularly advantageous arrangement is obtained when the cam holder is a control surface extending circularly around the piston and is arranged in a fixed position relative to same, and when the follower is directly or indirectly connected rigidly to the piston and is rotatable on the control surface around the piston axis. The follower may be able to be pressed against the control surface either under the effect of the force of gravity or under a spring pre-tension. This arrangement has the advantage that the rotary movement is transformed into an axial movement absolutely without play. Possible wear on the follower does not lead to any change in the stroke volume of the piston.

Further advantages can be achieved when the drive shaft is arranged such that it is coaxial with the piston and when a compression spring is arranged between the drive shaft and the piston, and at the same time the compression spring can also serve as a coupling member for torque transmission. The piston now performs its stroke movement under the spring pre-tension, and the spring tension may be set, if desired, such that the friction on the control surface will not be excessively strong.

In a particularly advantageous manner, the control surface is arranged directly on a front side of the cylinder. Such a cylinder can be manufactured in a particularly simple manner by cutting or grinding it obliquely on one side. The stroke volume is determined by the angle enclosed between the control surface and the piston axis. However, it would also definitely be possible to arrange the control surface on a control part that is interchangeable and/or adjustable.

The follower may be a pin or a similar sliding element, or, to reduce the friction, it may also be a rolling body rolling on the control surface.

If the cylinder and the piston are made of a ceramic material, it is possible to achieve particularly good running properties without the need for additional lubrication. Piston packings or similar parts are also unnecessary at low pressures, because the piston moves nearly without play in the cylinder. Ceramic materials are also resistant to corrosion, so that it would also be possible to deliver, e.g., chemically corrosive media.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 2:
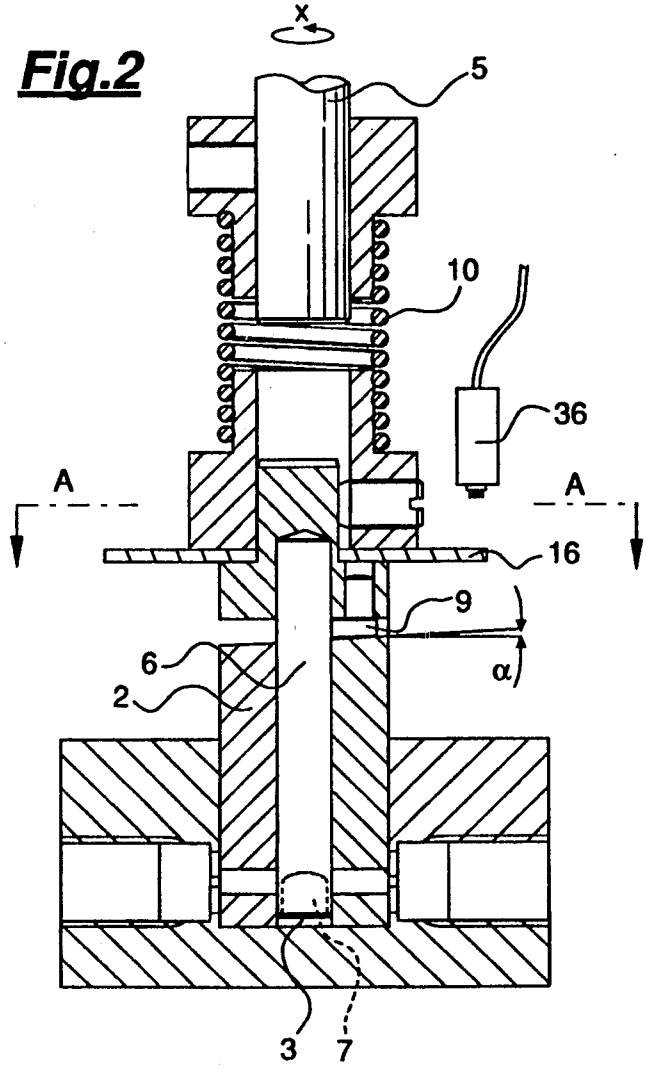
FIG. 2 is a cross sectional view of the pump according to FIG. 1 showing the pump in an upper lift position.
Figure 1:
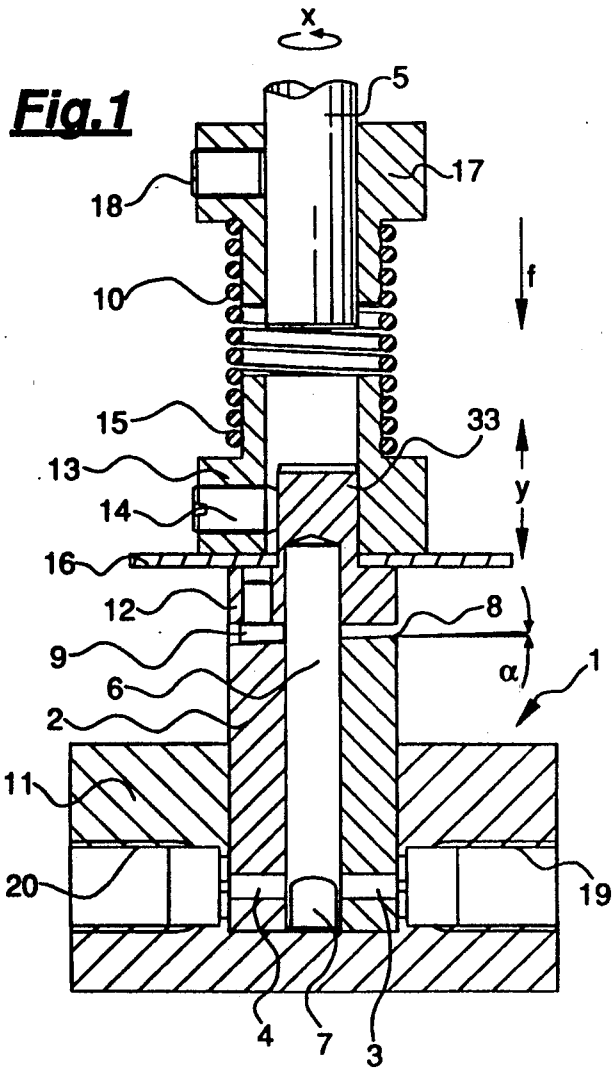
FIG. 1 is a cross sectional view through a pump according to the present invention in a lower lift position.
Figure 3:
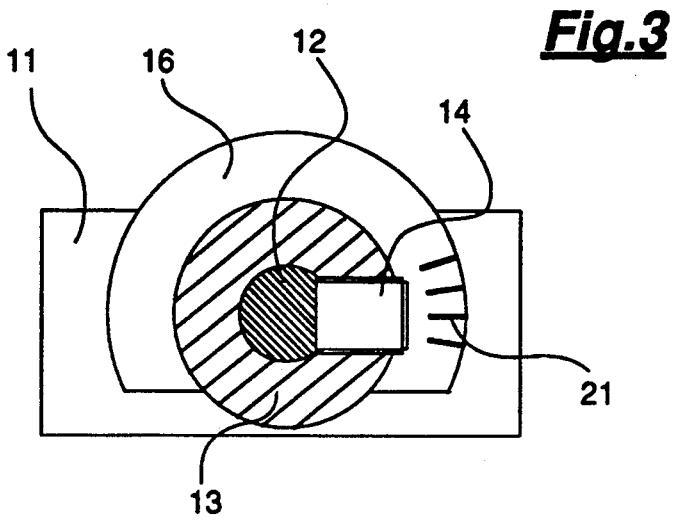
FIG. 3 is a sectional view taken in the direction of line A—A according to FIG. 2.

As is apparent from FIGS. 1 through 3, the axial piston pump 1 consists essentially of a cylinder 2, which is rigidly connected to a housing 11. One suction opening 3 each and one delivery opening 4 each are arranged at the lower end of the cylinder in the cylinder jacket, and the two openings are coaxial. Correspondingly, one connection 19 for a suction line and one connection 20 for a delivery line are arranged in the pump housing 11.

A piston 6, which is both rotatable around its own axis in the direction of arrow X, and able to perform an axial stroke in the direction of arrow Y and is guided in the cylinder 2. The lower end of the piston 6 is provided with a recess 7, which enlarges the pump chamber. Depending on the relative rotation position of the piston 6, the recess 7 communicates once with the suction opening 3 and at another time with the delivery opening 4, while the respective other opening is closed. Thus, the piston is able, in a simple manner, to draw in liquid or gas at the suction opening while the delivery opening is closed and to eject it through the delivery opening on reversal of the piston movement, while the suction opening is closed. As is also known, the piston can also be designed as a duplex piston with two pump chambers.

In the embodiment described here, the piston 6 is connected nonrotatably to a clutch hub 12. A follower 9 in the form of a sliding pin is fastened eccentrically to the clutch hub. The front side of the cylinder 2 is beveled to an angle alpha and thus forms a control surface or can surface 8 extending around the piston 6. However, instead of a flat beveling, it would also be possible to select a different cam shape in order to achieve a defined pump characteristic.

Rotational drive means is provided including a compression spring 10 fastened between the clutch hub 12 and the drive shaft 5 that is stationary relative to the cylinder 2. The compression spring presses the follower 9 against the control surface 8, so that the piston 2 is moved to and fro (back and forth) under spring pre-tension. However, the compression spring 10 also serves as a coupling for transmitting torque and thus assumes a dual function.

In its upper zone, the clutch hub 12 has a lug 33, which is provided with a tangential locking surface 15. The lug engages in a coupling sleeve 13, at which a set screw 14 can be tensioned radially against the surface 15, so that the clutch hub 12 is detachably connected to the compression spring. The compression spring 10 is connected at one end, nonrotatably to the coupling sleeve 13, and, at the other end, it is connected nonrotatably to the shaft hub 17. The shaft hub can be tensioned on the drive shaft 5 with a set screw 18, and the spring pre-tension can also be set in the direction of arrow f at the same time.

A coding disk 16, one side of which is cut off, is also fastened on the clutch hub 12. The coding disk cooperates with a sensor, e.g., a photosensitive sensor 36 (FIG. 2) and serves for rotation speed measurement. The coding disk may also have a line marking 21, so that it would also be possible to determine the accurate relative position of the piston, e.g., according to the principle of an incremental measuring system.

FIG. 1 shows the piston 6 in the lower lift position, in which it closes the delivery opening 4 and the suction opening 3 and in which the entire pump volume has just been ejected. During one revolution in the direction of arrow X, the follower 9 slides on the control surface 8 in the upward direction into the position shown in FIG. 2. The piston 6 is now pressed upward against the force of the compression spring 10 and reaches an upper lift position, in which both openings 3 and 4 are again closed. Between the two extreme lift positions according to FIGS, 1 and 2, the piston 6 has increased the volume of the pump chamber 34 and has drawn in the corresponding amount of medium being delivered, because the recess 7 communicates with the suction opening. During the further rotation of the piston, the follower 9 again slides into the lowermost relative position on the control surface 8, so that the piston is pressed in the downward direction, and it ejects the contents of the pump chamber 34 through the delivery opening 4.

Figure 7:
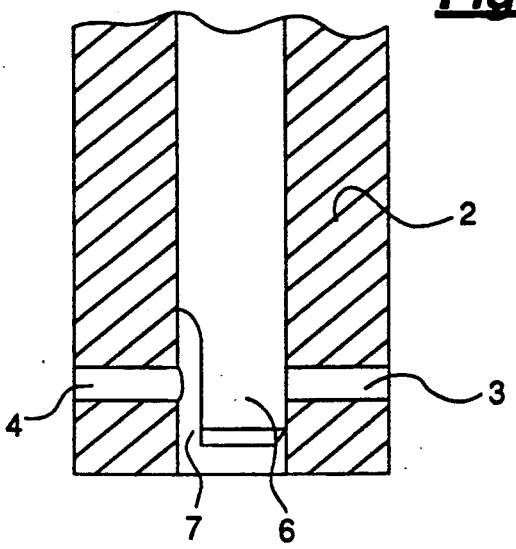
FIG. 7 is a cross sectional view showing the piston in the cylinder according to FIGS. 1-*b*, on an enlarged scale; and, FIG. 8 is a bottom view of the piston according to FIG. 7.
Figure 8:
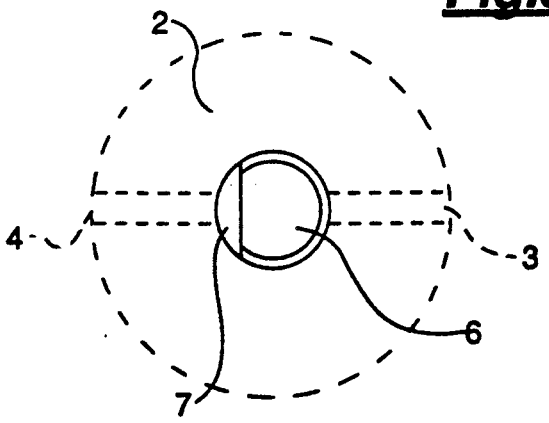

The shape of the piston is again shown on an enlarged scale in FIGS. 7 and 8. The recess 7 has the shape of a tangential cutout that is rounded at the top. In FIG. 7, the piston is rotated back through 90° compared with FIG. 1, and it closes the suction opening 3 and has performed half of its stroke.

Figure 4:
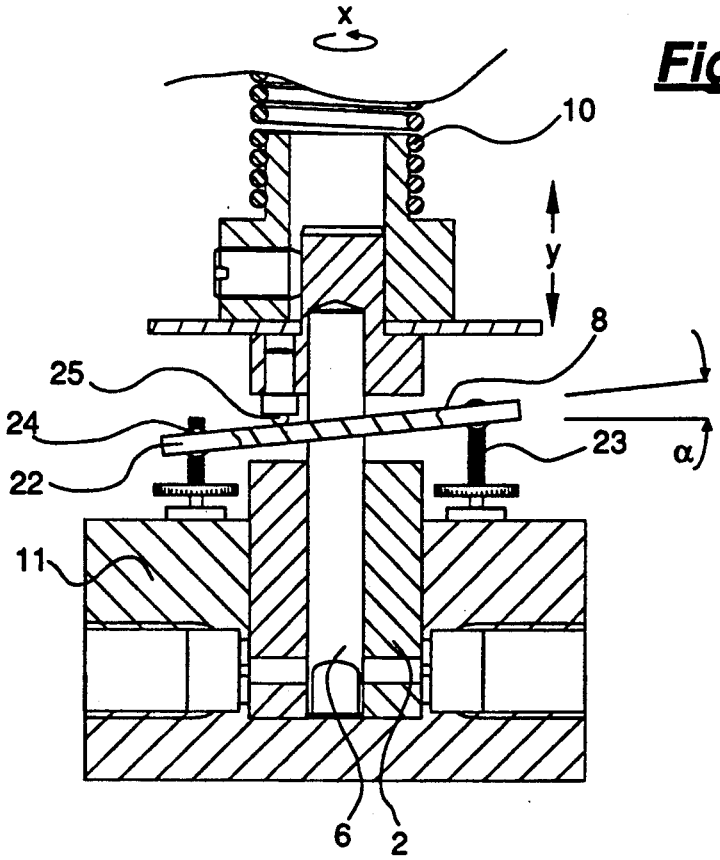
FIG. 4 is a cross sectional view of an alternative embodiment according to the invention with a adjustable control surface.

As can be seen, the angle alpha determines the maximum piston stroke and consequently also the pump [delivery] capacity. In many cases, it is not necessary at all for the pump stroke to be adjustable. However, FIG. 4 shows an exemplified embodiment in which the angle alpha can be adjusted by a certain amount. The control surface 8 is now arranged at a cam plate 22 rather than on the front side of the cylinder 2. The cam plate 22 is held by two diametrically opposite setscrews 23 which engage in nuts 24 on the cam plate. The nuts are designed as rotating or sliding elements, so that the inclination and the change in the distance can be compensated for. As can be seen, the desired angle alpha can be set by turning the setscrews 23. In the exemplified embodiment according to FIG. 4, the follower is designed as a ball 25, which rolls on the control surface 8. The other components in this exemplified embodiment ar identical to those in the exemplified embodiment according to FIGS. 1 through 3. Instead of a continuously adjustable cam plate 22, it would also be conceivable to manufacture individual control parts which can be interchangeably connected to the front (top) side of the cylinder 2 and which have control surface with different angles. It would thus be possible to select different, permanently set angles.

Figure 5:
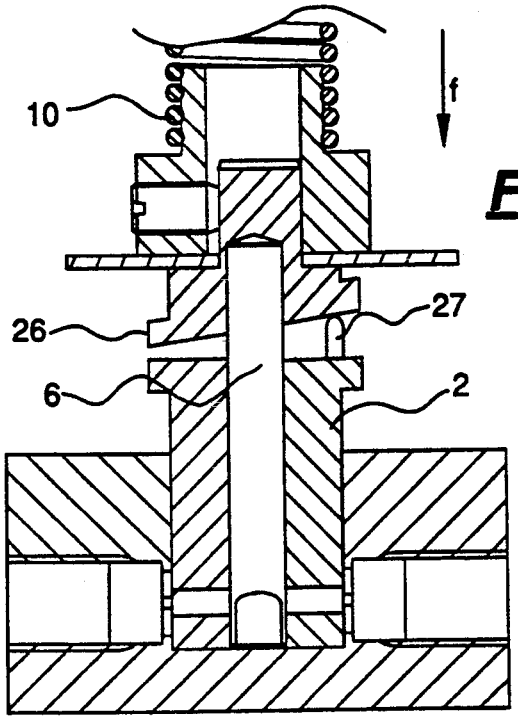
FIG. 5 is a cross sectional view showing another embodiment of the invention with a swash plate on the piston.

As is apparent from FIG. 5, the cam holder need not be arranged rigidly in all cases. In this exemplified embodiment, the piston 6 is rigidly connected to a swash plate 26, which forms the control cam. The swash plate is pressed by the compression spring 10 against a sliding pin 27, which is rigidly arranged on the cylinder 2. As can be seen, axial movement of the piston takes place during the rotation of the piston 6 or the swash plate 26.

Figure 6:
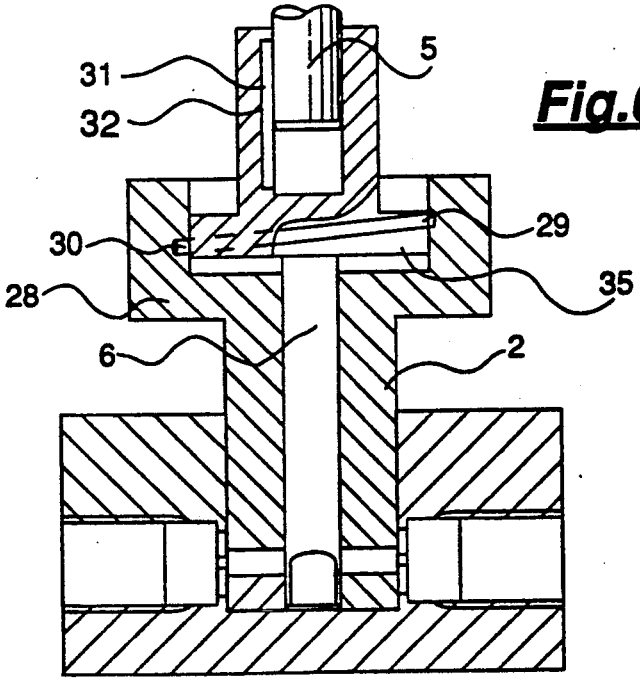
FIG. 6 is a cross sectional view showing another embodiment of the invention with a circular groove acting as a cam holder.

Finally, FIG. 6 shows another exemplified embodiment, in which spring pre-tension is not absolutely necessary. The cylinder 2 has a section 28 with increased internal diameter. An obliquely positioned or cam-shaped groove 29 is arranged on the inside at this section. The expanded section 35 has a bolt 30, which engages radially in the groove 29. As can be seen, forced movement in the axial direction takes place during the rotation of the piston 6, corresponding to the guiding provided by the groove 29. The relative axial displacement between the drive shaft 5 and the piston 6 can be compensated for by an axial groove 31, which slides nonrotatably on the shaft 5 via an axial guide 32. The axial guide also serves to transmit the torque. However, in a fully similar manner, the groove would also be able to be arranged at the expanded piston section 35, while the bolt 30 is arranged rigidly on the inner jacket of the cylinder.

In all exemplified embodiments, the cylinder 2 and the piston 6 are preferably made of a ceramic material. It is thus possible to guide the piston without packing in the cylinder under pressures of up to ca. 1 bar. In addition, the parts are highly resistant to wear, which is significant especially when the control surface 8 is arranged directly on the cylinder 2.

While specific embodiments of the invention have been shown and described in detail to illustrate the application of the principles of the invention, it will be understood that the invention may be embodied otherwise without departing from such principles.

What is claimed is:

1. An axial piston pump, comprising a cylinder with at least two cylinder openings formed in a cylinder jacket; a piston positioned in said jacket for rotation about a piston axis, said piston including a recess at one end of said piston in the area of said cylinder openings, said recess communicating with one of said cylinder openings upon rotation of said piston; a drive shaft coupled to said piston for driving said piston in rotation; periodic axial movement means for displacing said piston axially during each revolution of said piston, said periodic axial movement means including a cam surface connected to one of said rotational drive means and said cylinder and a cam follower connected to the other one of said rotational drive means and said cylinder, the position of said cam follower with respect to said cam surface determining the piston stroke during each piston revolution said cam surface is formed as a control surface that extends around said piston, said cam surface being arranged rigidly relative to said piston, said cam follower being directly or indirectly connected rigidly to said piston for rotation on said control surface, around the piston axis; coded disk including a marking, said coded disk being nonrotatably connected to said piston for rotation therewith; and sensor means, positioned adjacent said coded disk, said sensor means said marking to measure rotation of said piston for monitoring dosing of fluids; and spring tension means for pressing said cam follower against said control surface wherein said rotational drive means includes a drive shaft positioned coaxial with said piston, said spring tension means including a compression spring arranged between said drive shaft and said piston.

2. An axial piston pump according to claim 1, wherein said compression spring acts as a coupling element for torque transmission between said drive shaft and said piston.

3. An axial piston pump according to claim 7, wherein said piston is connected to a clutch hub, said cam follower being arranged on said clutch hub, said clutch hub being detachably connected to said compression spring.

4. An axial piston pump according to claim 3, wherein said compression spring is connected to said piston at a piston side end, said piston side end being connected to a coupling sleeve, said clutch hub engaging said coupling sleeve and being fixed relative to said coupling sleeve via a set screw.

5. An axial piston pump according to claim 1, wherein said control surface is arranged on a top side of said cylinder.

6. An axial piston pump according to claim 1, wherein said cam follower is formed as a pin which slidable on said control surface.

7. An axial piston pump according to claim 1, wherein said cam follower is a rolling body which is rollably engaged with said control surface.

8. An axial piston pump according to claim 1, wherein said cylinder and said piston are each formed of a ceramic material.

9. An axial piston pump, comprising a cylinder with at least two cylinder openings formed in a cylinder jacket; a piston positioned in said jacket for rotation about a piston axis, said piston including a recess at one end of said piston in the area of said cylinder openings, said recess communicating with one of said cylinder openings upon rotation of said piston; a drive shaft coupled to said piston for driving said piston in rotation; periodic axial movement means for displacing said piston axially during each revolution of said piston, said periodic axial movement means including a cam surface connected to one of said rotational drive means and said cylinder and a cam follower connected to the other one of said rotational drive means and said cylinder, the position of said cam follower with respect to said cam surface determining the piston stroke during each piston revolution said cam surface is formed as a control surface that extends around said piston, said cam surface being arranged rigidly relative to said piston, said cam follower being directly or indirectly connected rigidly to said piston for rotation on said control surface, around the piston axis; coded disk including a marking, said coded disk being nonrotatably connected to said piston for rotation therewith; and sensor means, positioned adjacent said coded disk, said sensor means said marking to measure rotation of said piston for monitoring dosing of fluids, said control surface being arranged as a control part which is interchangeable and/or adjustable.

* * * * *